United States Patent [19]

Doinel

[11] Patent Number: 4,601,184

[45] Date of Patent: Jul. 22, 1986

[54] SAFETY LOCK

[75] Inventor: Gérard H. D. Doinel, Oustmarest par Ault, France

[73] Assignee: Fichet Bauche, France

[21] Appl. No.: 649,122

[22] Filed: Sep. 10, 1984

[30] Foreign Application Priority Data

Sep. 16, 1983 [FR] France ..... 83 14789
Sep. 16, 1983 [FR] France ..... 83 14790

[51] Int. Cl.[4] ..... E05B 29/06

[52] U.S. Cl. ..... 70/360; 70/365; 70/366; 70/372; 70/375; 70/377; 70/380

[58] Field of Search ..... 70/360, 357, 358, 361, 70/362, 365, 366, 372, 375–377, 379 R, 379 A, 380

[56] References Cited

U.S. PATENT DOCUMENTS

| | | | |
|---|---|---|---|
| 2,032,974 | 3/1936 | Bradshaw et al. | 70/46 |
| 2,221,664 | 11/1940 | Susser | 70/384 |
| 3,485,068 | 12/1969 | Bennett | 70/379 R |
| 3,505,842 | 4/1970 | Taylor | 70/365 |

FOREIGN PATENT DOCUMENTS

| | | | |
|---|---|---|---|
| 815791 | 6/1969 | Canada | 70/360 |
| 65879 | 2/1892 | Fed. Rep. of Germany . | |
| 507106 | 9/1930 | Fed. Rep. of Germany | 70/366 |
| 1167691 | 4/1964 | Fed. Rep. of Germany . | |
| 1553448 | 9/1970 | Fed. Rep. of Germany | 70/365 |
| 2833005 | 2/1980 | Fed. Rep. of Germany | 70/365 |
| 655128 | 4/1929 | France . | |
| 855330 | 5/1940 | France . | |
| 912442 | 8/1946 | France . | |
| 2489399 | 3/1982 | France . | |
| 251106 | 4/1926 | United Kingdom . | |
| 654750 | 6/1951 | United Kingdom | 70/362 |

*Primary Examiner*—Robert L. Wolfe
*Assistant Examiner*—Lloyd A. Gall
*Attorney, Agent, or Firm*—Steinberg & Raskin

[57] ABSTRACT

The present invention relates to a safety lock including a cylindrical body in which is movably mounted a cylinder containing a safety mechanism which is constituted by pivoting blades meshing respectively with toothed wheels loosely mounted on an axis pin transversely connected to a cylinder and each provided with a notch adapted to be positively and drivingly connected to a catch for operating the lock mechanism, only after the notches are caused to coincide with the catch which initially is spaced from the wheels.

9 Claims, 5 Drawing Figures

Fig. 3
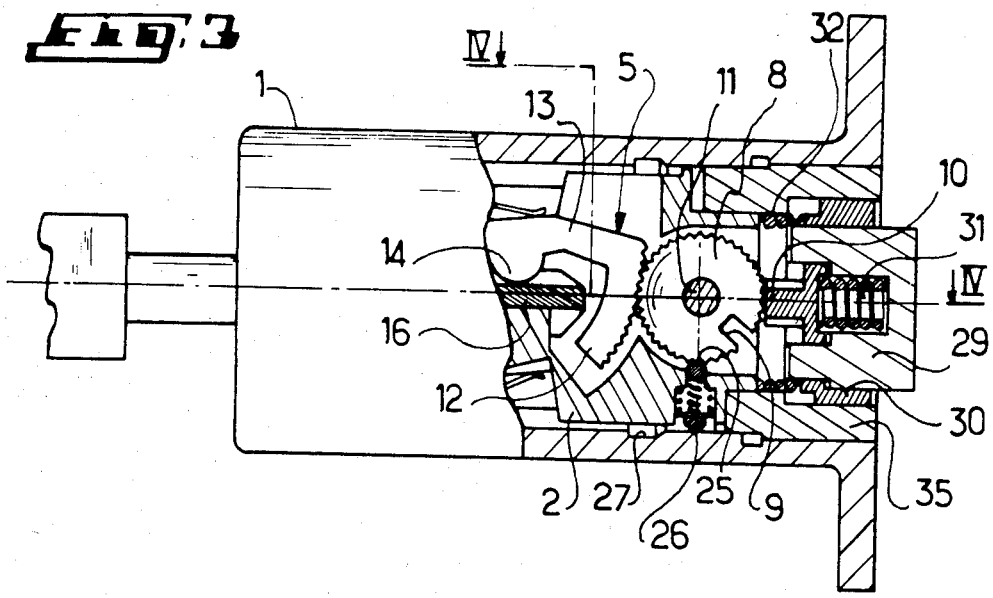
Fig. 4
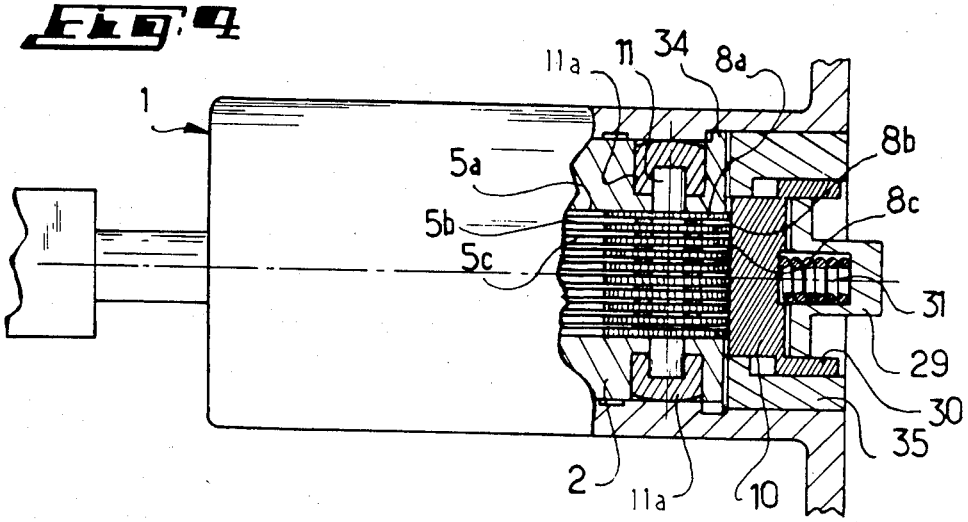
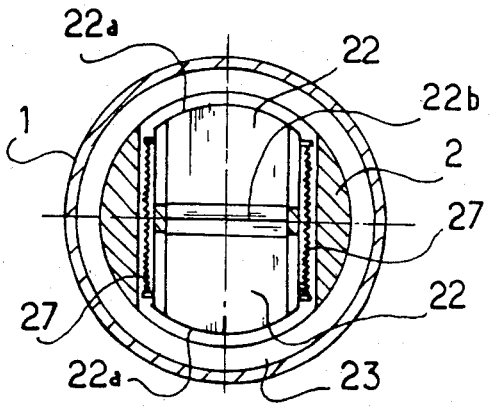
Fig. 5

SAFETY LOCK

The present invention has essentially for a subject matter a highly improved safety lock.

Background of the Invention

There are already known safety locks including generally a cylindrical body within which is axially and rotatably mounted a cylinder or rotor containing safety means and adapted to be actuated by a key to operate a lock mechanism. The insertion of the key into the lock first allows arming the safety means, owing to which the key can thereafter actuate the lock mechanism proper, i.e., ultimately, bolts ensuring the locking of, for example, a door.

However, the safety locks proposed up to the present suffered from a certain number of disadvantages. For example, when a house-breaker attempted to force the lock by inserting therein, for example, a false key, the safety portion associated with the lock mechanism was necessarily destroyed, which required complete replacement of the lock. Moreover, in the known safety locks, the commbination of the lock could not be changed without changing the safety portion of the lock or adding to it additional parts, which required relatively long and expensive work. It may also be added here that in the known safety locks, the safety means were always positively and permanently connected to the catch or fastening system, so that the actuation of this mechanism by picking or "feeling" the safety means as relatively easy to an experienced house-breaker. Lastly, it can also be said here that the dimensions of the inlet orifice of the existing locks correspond at least to those of the bit or web of the key, and this orifice, in spite of all, provides convenient access and facilitates the insertion of a picking tool or a false key.

The present invention has as its purpose to remedy particularly the above drawbacks, as well as many others, by providing a novel safety lock whose structure and components are such that a house-breaker attempting to force the lock, which besides is simple and inexpensive, will necessarily meet with multiple difficulties which, on the whole, render the said lock practically manipulation-proof.

To this end, the invention has for a subject matter a safety lock including a cylindrical body within which is mounted axially and rotatably a cylinder containing at least one pivoting member adapted to be actuated by a key and authorizing the operation of a lock mechanism by rotation of the cylinder in the cylindrical body after axial displacement of the said cylinder towards the said mechanism, characterized in that the said pivoting member is in constant mesh with a toothed wheel which is loosely mounted on an axis pin transversely connected to the cylinder and which is provided with a notch opening onto the periphery of the said wheel and capable of being positively and drivingly connected to an element of the lock mechanism after the said notch is aligned with the said element and the said wheel is displaced towards the latter.

It is therefore already understood that the safety means of the lock include a toothed wheel which in normal position is spaced from the lock mechanism operating the bolts, so that if the safety means are not armed by means of the adequate key, the said wheel will rotate freely without actuating the mechanism of the lock, and, as a result, there is no risk that the interior of the lock might be damaged.

According to a preferred form of embodiment, the aforesaid pivoting member is constituted by two blades pivotally mounted on the cylinder symmetrically with respect to its axis and each meshing with a toothed wheel carried by the aforesaid axis pin, which two blades may each constitute a group of blades each meshing with a toothed wheel.

It will also be specified here that the axis pin carrying the said toothed wheel or wheels is advantageously removably mounted by its two ends in the cylinder, by means of, for example, two plugs set in the wall of the said cylinder.

The group of toothed wheels may be conveniently extracted from the cylinder previously removed from the lock body to allow changing the combination of the lock in accordance with the new key desired to be used.

According to another feature of the invention, two mutually-opposite movable plates forming a lock inlet shield, curtain or guard are slidingly mounted at one of the ends of the cylinder and are adapted to cooperate by their external edge with a groove provided in the interior of the aforesaid cylindrical body, and by their internal edge with a transverse slot provided on both faces of the key bit or web.

According to another feature of the invention, each said slot is located in proximity to the heel or shoulder of the key bit and is shaped in cross-section in the approximate form of a U, one of the legs of which is at right angles to the longitudinal axis of the key, the other leg forming an acute angle with the said longitudinal axis.

The lock according to the invention is also characterized by an assembly of two fingers each acted upon by a spring and mounted in opposition to one another in the wall of the cylinder, one of the said fingers projecting inwardly of the cylinder to lock the toothed wheel or wheels when the other finger cooperates with an inclined surface provided on the internal periphery of the cylindrical body of the lock.

According to a preferred form of embodiment, the said pivoting blade or blades are each shaped substantially in the form of an L, one of the sides of which constitutes a toothed sector meshing with a toothed wheel, whereas the other side, pivotally connected to the cylinder, is provided with a portion projecting inwardly of the L and cooperating with the key bit.

It will also be added here that the two said blades or groups of blades are pivotally mounted on either side, respectively, of an axial cavity for guiding the key, and are constantly urged by springs toward the axis of the cylinder.

The aforesaid cavity for inserting and guiding the key is defined particularly by bearing surfaces provided with slots and splines or ribs cooperating with longitudinal splines and slots, respectively, provided on each face of the key bit and selectively actuating the aforesaid pivoting blades.

But other features and advantages of the invention will appear more clearly as the following detailed description proceeds with reference to the appended drawings given solely by way of example and wherein:

BRIEF DESCRIPTION OF THE DRAWINGS

FIG. 3 is a view identical with those of FIGS. 1 and 2, but showing still another position of the members of the safety mechanism when a false key is inserted into the lock;

FIG. 4 is a sectional view upon the line IV—IV of FIG. 3, and

FIG. 5 is a sectional view upon the line V—V of FIG. 1, showing the movable inlet shield of the lock.

DESCRIPTION OF THE PREFERRED EMBODIMENTS

Figure 1:
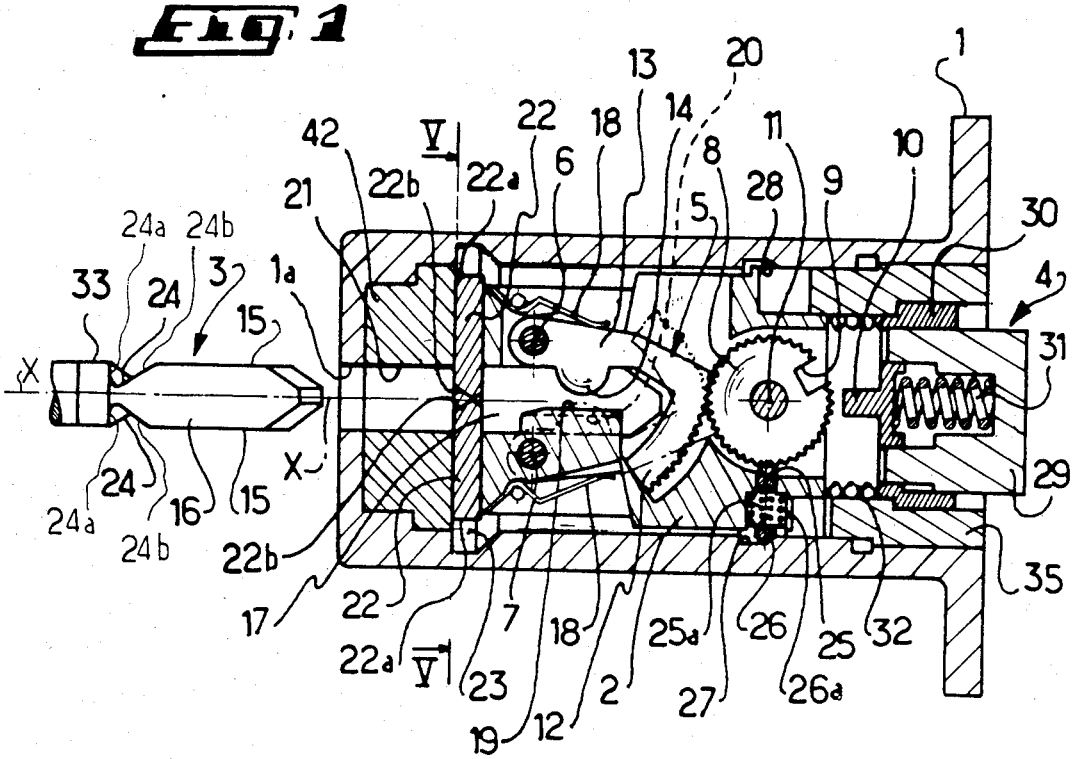
FIG 1 is an axial sectional view of a lock according to the invention, the said section being perpendicular to the axis pin carrying the toothed wheels forming part of the safety mechanism.

According to one example of embodiment, and referring to the appended drawings, a safety lock according to the invention includes essentially a cylindrical body 1 in which is slidingly mounted a cylinder 2 constituting the safety portion of the lock and which can be actuated by a special key 3 to operate a lock mechanism designated generally by the reference numeral 4.

Figure 2:
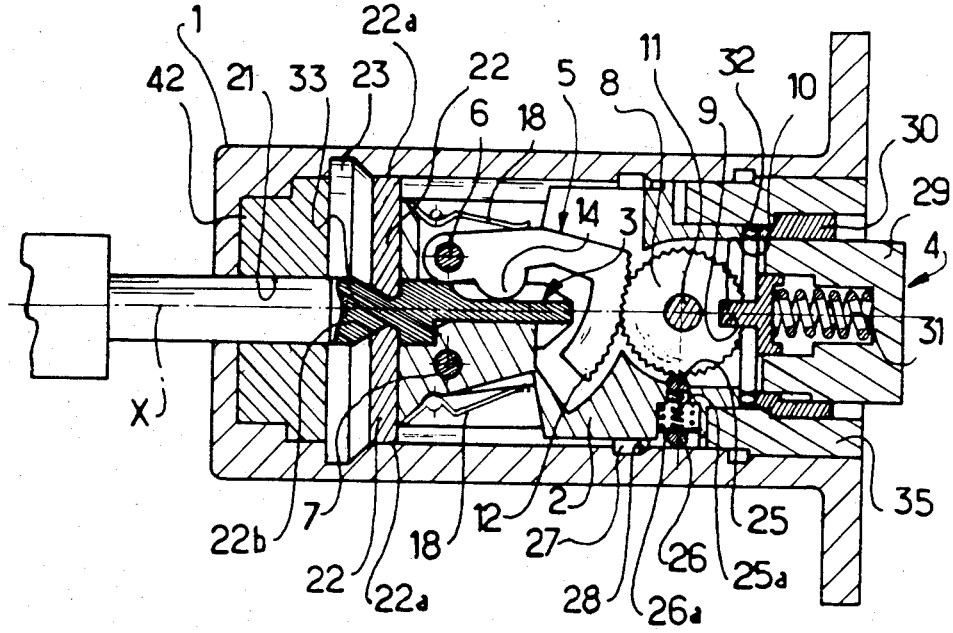
FIG. 2 is a view identical with that of FIG. 1, but showing another position of the safety members, when the key is inserted and ready to actuate the lock mechanism.

The cylinder 1 contains two sets or groups of pivoting blades or tumblers 5, one of the said sets being pivoted at 6 and the other at 7. In FIGS. 1 to 3, there is shown in solid lines, for the sake of clarity, only one set of pivoting blades 5, i.e., the one pivotally connected at 6 to the cylinder 2.

Each blade 5 meshes with a toothed wheel 8 provided at its periphery with a notch 9 adapted to be connected to a catch or the like 10 forming part of the lock mechanism 4 which operates the bolts (not shown).

As better seen in FIG. 4, all the toothed wheels 8*a*, 8*b*, 8*c* . . . cooperating with the blades 5*a*, 5*b*, 5*c* . . . , respectively, are loosely mounted and freely rotatable about an axis pin 11 removably mounted by its two ends in the wall of the cylinder 2 through the medium of plugs 11*a* set in the said wall.

Reverting to FIGS. 1 to 3, it is seen that each blade 5 is substantially shaped in the form of an L, one side 12 of which constitutes a toothed sector meshing with the wheel 8, whereas the other side 13 is pivotally connected to the cylinder and provided with a portion 14 projecting inwardly of the L-shaped blade and adapted to cooperate with the faces 15 of the bit or web 16 of the key 3, as will be explained later.

The two sets of blades 5 pivotally connected at 6 and 7, respectively, to the cylinder 2 are imbricated by their toothed sector portion 12, so that, as seen in FIG. 4, the blade 5*a* pivoted at 6 meshes with the wheel 8*a*, the blade 5*b* pivoted at 7 meshes with the wheel 8*b*, the blade 5*c* pivoted at 6 meshes with the wheel 8*c*, and so on. In other words, the blades or tumblers 5 are imbricated and superposed by their portion 12 to each mesh with a wheel 8, it being understood that the blades pivotally connected at 7 to the cylinder 2 are symmetrical with the blades pivoted at 6, as shown in dotted lines in FIG. 1. It is therefore already understood that by moving a blade pivoted at 6 and a blade pivoted at 7 from or towards one another, the wheel associated with one of the blades will turn in the opposite direction to the wheel associated with the other blade.

As seen in FIGS. 1 and 2, the two sets of blades are pivoted on either side, respectively, of a cavity or recess 17 provided in the cylinder 2 and serving as an axial guiding means for the key 3. Each blade of the two groups of blades are urged by springs 18 towards the cavity 17 or the axis X of the cylinder 2. The cavity 17 is defined particularly by guiding surfaces 19 provided with slots and splines or ribs diagrammatically denoted at 20 which are complementary to longitudinal splines and slots (not shown), respectively, provided on each side or face 15 of the bit 16 of the key 3 selectively actuating the blades 5.

The orifice for inserting the key 3 is constituted by the alignment of an orifice 1*a* provided in the cylindrical body 1, an orifice 21 provided in an element 42 associated with the end-wall of the body 1, and of the aforesaid cavity 17 in the cylinder 2.

At the end of the cylinder 2, as better seen in FIG. 5, are slidingly mounted two plates 22 forming a movable curtain or shield and adapted to cooperate by their external edge 22*a* with a groove 23 provided in the internal periphery of the cylindrical body 1. The two plates 22 are also adapted to cooperate by their mutually opposite internal edges 22*b* with two mutually opposite transverse slots 24 provided on the bit 16 of the key 3 in proximity to the heel or shoulder 33 of the bit.

The two slots 24 impart to the bit 16 a narrowed cross-sectional shape and each slot is shaped in cross-section in the form of a U, one (24*a*) of the legs of which is at right angles to the axis X of the key 3 whereas the other leg 24*b* forms an acute angle with the axis X.

The plates 22 of the movable shield are constantly urged to the closed position by springs 27 clearly seen in FIG. 5.

There are shown at 25 and 26 two fingers mounted in opposition to one another in the wall of the cylinder 2 and each acted upon by a spring 25*a*, 26*a*, respectively. The spring 26*a* is stronger than the spring 25*a*, so that the finger 26 is maintained in protracted position in a recess 27 provided at the internal periphery of the cylindrical body 1, so that the finger 25 is in retracted or sunk position in the wall of the cylinder 2. This is clearly shown in FIG. 1.

The recess 27 has an inclined surface portion 28 which, as a result of the displacement of the cylinder 2 in the cylindrical body 1, pushes the finger 26 so that the finger 25 projects inwardly of the cylinder 2 to thus lock the wheels 8, as clearly seen in FIGS. 2 and 3.

The lock mechanism 4, which operates, for example, the bolt means, is of a type known per se and, as seen in the Figures, includes essentially a member 29 actuating the bolts and solid in rotation with another member 30 carrying the catch 10. A spring 31 is arranged between the members 29 and 30 which can rotate in a ring member 35 forming a sliding support surface for the cylinder 2. It will be added here that a spring 32 is provided between the cylinder 2 and the member 30 so as to constantly urge the latter and therefore the catch 10 to a position spaced and disconnected from the wheels 8.

There will now be described the operation and advantages of the safety lock of the invention just described.

When the key is inserted into the lock, it first passes through the movable shield by radially moving from one another the plates 22 which thus engage the groove 23 and prevent the displacement of the cylinder 2 in the cylindrical body 1. The insertion continues until plates 22 acted upon by the springs 27 close onto the transverse slots 24 of the key 3.

At this stage, the bit 16 of the key 3 will have acted upon the two sets of pivoting blades 5 and achieved the alignment of the notches 9 of all the wheels 8, the said notches of course being opposite the catch 10.

Therefore, by pushing the key 3 and as seen in FIG. 2, the notches 9 are moved onto the catch 10 and the rotation of the key resulting in the rotation of the cylinder 2 ensures the rotation of the catch 10 and therefore of the member 29 which operates the bolts, thus ensuring the locking of, for example, a door.

If, as seen in FIG. 3, a false key with transverse slots 24 is introduced, which allows the closing of the plates 22, as explained above, the blades 5 will rotate the wheels 8 which, as seen earlier, are loosely mounted on the axis pin 11 and the wheels will not be in the position of connection of the notches 9 with the catch 10. On further insertion of the key, the stud 34 is disengaged from its slot, the catch 10 is pushed against the action of the spring 31, and the cylinder assembly can thus be rotated without driving the lock mechanism and without damaging the safety means. If, on the contrary, a false key without transverse slots 24 is introduced, the cylinder is immobilized in its initial position, from which it can be neither pushed nor rotated, the blades 22 of the movable shield preventing its displacement.

Furthermore, it will be noted that the plates of the movable shield at the inlet of the lock contribute to the safety by limiting the accessibility to picking tools since the said plates must be practically closed to allow the displacement of the cylinder in the cylindrical body of the lock.

Moreover, as explained previously, the fingers 25 and 26 lock the wheels 8 during the displacement of the cylinder 2. If, therefore, a pressure is exerted on the shield in closed position, the cylinder can be displaced, but the wheels 8 are locked, so that, if a house-breaker should attempt to insert between the plates of the shield a "feeling" or picking tool (if indeed he succeeds in doing so, considering the very limited accessibility of the lock when the shield is closed, as explained earlier), he cannot, in any case, actuate the blades 5 since the wheels 8 are locked.

It will also be added here that when the key is inserted into the movable shield, as seen in FIG. 2, the rear or heel portion 33 of the key 3 projects from the cylinder 2 and is equal in length to the useful travel of the cylinder until the rotation, the said heel rubbing during the rotation against member 42, thus preventing the key from coming out. The key of the invention also includes other elements known per se and which it is not necessary to describe here in detail, such as, for example, the stud 34 seen in FIG. 4 and arranged to cooperate with a groove in the internal periphery of the cylindrical body 1, in order that the cylinder can rotate only when the notches 9 of the wheels 8 are in engagement with the catch 10.

It will also be stressed here that the group of toothed wheels 8 forms a unit which can be easily extracted from the cylinder to allow changing the combination of the lock without changing the whole assembly, in case it is desired to eliminate the key in service and to replace it by another one. Thus, it will be sufficient for a fitter to provide a new key without providing a new safety mechanism.

There is therefore obtained a particularly improved safety lock capable of perfectly resisting picking attempts, of relatively simple and low-cost design and requiring no replacement when it is desired to change the combination of the safety mechanism.

Of course, the invention is by no means limited to the form of embodiment described and illustrated which has been given by way of example only.

For example, use can be made in the lock of the invention of a single pivoting blade and a single wheel meshing with this blade, or a single set of pivoting blades, although the use of two sets of blades is preferable from the point of view of security against picking and "feeling" of the blades. Likewise, there may be provided on the toothed wheels a means other than a notch cooperating with the lock mechanism.

The invention therefore includes all technical equivalents to the means described as well as their combinations should the latter be carried out according to its gist.

What is claimed is:

1. A safety lock of the type including a cylindrical body in which is axially and rotatably mounted a cylinder containing at least one pivoting member adapted to be actuated by a key and authorizing the operation of a lock mechanism by rotation of the cylinder in the cylindrical body after axial displacement of the said cylinder towards the said mechanism, characterized in that the said pivoting member has teeth and is in constant mesh with a toothed wheel which is loosely mounted on an axis pin transversely connected to the cylinder and which is provided with a notch opening onto the periphery of the said wheel and capable of positive driving connection with an element of the lock mechanism after the said notch is aligned with the said element and the said wheel is displaced towards the latter.

2. A lock according to claim 1, characterized in that the said pivoting member is constituted by two blades pivotally mounted on the cylinder symmetrically with respect to its axis X and each meshing with a toothed wheel carried by the said axis pin, which two blades may each constitute a group of blades each meshing with a toothed wheel.

3. A lock according to claim 2, characterized in that the said blade or blades are each shaped substantially in the form of an L, one of the sides of which constitutes a toothed sector meshing with a toothed wheel and the other side of which is pivotally connected to the cylinder and is provided with a portion projecting inwardly of the L-shaped blade and cooperating with the bit of the key.

4. A lock according to claim 2, characterized in that the said two blades or groups of blades are pivotally mounted on either side, respectively, of an axial cavity for guiding the key, and are constantly urged by springs towards the axis X of the cylinder.

5. A lock according to claim 4, characterized in that the said guiding cavity is defined particularly by bearing means provided with slots and splines cooperating with longitudinal splines and slots, respectively, provided on each face of the bit of the key selectively actuating the said pivoting blades.

6. A lock according to claim 1, characterized in that the axis pin carrying the said toothed wheel is removably mounted by its two ends in the cylinder by means of, for example, two plugs set in the wall of the cylinder.

7. A lock according to claim 1, characterized by the mutually-opposite movable plates constituting a lock inlet shield, slidingly mounted at one of the ends of the cylinder and adapted to cooperate by their external edge with a groove provided within the cylindrical body, and by their internal edge with a transverse slot provided on both faces of the bit of the key.

8. A lock according to claim 7, characterized in that each said slot is located in proximity to a heel of the key bit and is shaped in cross-section in the approximate form of a U, one of the legs of which is at right angles to the longitudinal axis X of the key whereas its other leg forms an acute angle with the said axis X.

9. A lock according to claim 1, characterized by an assembly of two fingers each acted upon by a spring and mounted in opposition to one another in the wall of the cylinder, one of the said fingers projecting inwardly of the cylinder to lock the toothed wheel when the other finger cooperates with an inclined surface provided on the internal periphery of the cylindrical body.

* * * * *